US008803748B2

(12) United States Patent
Lim et al.

(10) Patent No.: US 8,803,748 B2
(45) Date of Patent: Aug. 12, 2014

(54) LOW-PROFILE ANTENNA RECEIVING VERTICAL POLARIZED SIGNAL

(75) Inventors: Sungjoon Lim, Anyang-si (KR); Seunghee Baek, Bucheon-si (KR); Yong Soo Cho, Seoul (KR)

(73) Assignee: Chung-Ang University Industry-Academy Cooperation Foundation, Seoul (KR)

( * ) Notice: Subject to any disclaimer, the term of this patent is extended or adjusted under 35 U.S.C. 154(b) by 521 days.

(21) Appl. No.: 13/115,317

(22) Filed: May 25, 2011

(65) Prior Publication Data

US 2012/0038526 A1 Feb. 16, 2012

(30) Foreign Application Priority Data

Aug. 11, 2010 (KR) ..... 10-2010-0077445

(51) Int. Cl.
*H01Q 1/32* (2006.01)
*H01Q 1/38* (2006.01)
*H01Q 9/04* (2006.01)

(52) U.S. Cl.
CPC ..... *H01Q 1/38* (2013.01); *H01Q 1/3275* (2013.01); *H01Q 9/0407* (2013.01)
USPC ..... 343/713; 343/711

(58) Field of Classification Search
USPC ..... 343/711–717
See application file for complete search history.

(56) References Cited

U.S. PATENT DOCUMENTS

2005/0099338 A1* 5/2005 Noro et al. ..... 343/700 MS
2005/0156802 A1* 7/2005 Livingston et al. ..... 343/770
2006/0145937 A1* 7/2006 Chang et al. ..... 343/840
2008/0048917 A1 2/2008 Achour et al.
2011/0057853 A1* 3/2011 Kim et al. ..... 343/843

FOREIGN PATENT DOCUMENTS

KR 1020050117316 A 12/2005

* cited by examiner

*Primary Examiner* — Michael G Lee
*Assistant Examiner* — Matthew Mikels
(74) *Attorney, Agent, or Firm* — William Park & Associates Patent Ltd.

(57) ABSTRACT

A low-profile antenna is provided. A laminated substrate is formed into a structure in which a plurality of substrates having different permittivities are stacked, and a radiator consists of a plurality of unit patches disposed on an upper surface of the laminated substrate and generates an electric field perpendicular to the upper surface of the laminated substrate. Ground vias are formed from the respective unit patches to a ground plane disposed on a lower surface of the laminated substrate through the substrates constituting the laminated substrate. In the low-profile antenna, the radiator consisting of the plurality of patches is disposed on the upper surface of the laminated substrate having a structure in which the plurality of substrates are stacked to generate a magnetic loop around the patches, so that vertical polarized signals can be received due to a magnetic field perpendicular to the upper surface of the laminated substrate.

12 Claims, 8 Drawing Sheets

(a)

(b)

LOW-PROFILE ANTENNA RECEIVING VERTICAL POLARIZED SIGNAL

CROSS-REFERENCE TO RELATED APPLICATION

This application claims priority to and the benefit of Korean Patent Application No. 2010-77445, filed on AUG 11, 2010, the disclosure of which is incorporated herein by reference in its entirety.

BACKGROUND

1. Field of the Invention

The present invention relates to a low-profile antenna, and more particularly, to an antenna capable of receiving vertical polarized signals with a planar structure rather than an obliquely disposed structure.

2. Discussion of Related Art

For vehicle communication, a vehicle antenna that is reliable and inexpensive and can be simply manufactured is required. The vehicle antenna needs to be mounted at a position where a signal can be efficiently received. Most research on vehicle antennas has been conducted in regard to various mounting positions, such as a window, a wheel, a vehicle body, and a vehicle roof. For example, research has been conducted on a case where a vehicle antenna is mounted for digital terrestrial reception on the top of the front and rear windows, and other research has been conducted on an influence that vehicle equipment has on the performance of an antenna mounted on a window. Also, electromagnetic simulation results of a global positioning system (GPS) antenna mounted on a windshield have been disclosed.

A vehicle roof is a particularly good position to mount an antenna. An antenna installed on a vehicle roof needs to have a low profile to be protected from a severe environment, and the appearance of a vehicle also needs to be considered. For these reasons, a variety of vehicle roof-mounted antennas, such as a monopole antenna, a planar inverted-F antenna (PIFA), and a printed circuit board (PCB) antenna, have been suggested. However, such a protruding antenna is easily damaged by an environmental condition and may ruin the profile of a vehicle. Thus, a low-profile antenna, such as a hidden antenna mounted on a vehicle roof, is required as a roof-mounted antenna.

Due to horizontal polarization, a low-profile antenna is easily designed for satellite communication. On the other hand, it is difficult to implement a low-profile antenna having a characteristic of receiving vertical polarized signal for a terrestrial service. To implement an antenna that receives vertical polarized signals on a low-profile aperture, a zero-phase constant, a surface wave, or a small magnetic loop may be applied.

Among conventional antennas, a metamaterial ring antenna having a height of 6.8 mm ($\lambda_0/28$) generates vertically polarized current distribution. In this antenna, two vertical vias become in-phase due to the zero insertion phase between them. Alternately, a surface wave antenna capable of receiving vertical polarized signals has been suggested. This antenna consists of a thin grounded dielectric slab and periodic patches, and is excited by a circular patch. Surface wave diffraction on the slab causes vertical polarization, and a thickness of the antenna is 3 mm ($0.05\lambda_0$). In another antenna, vertical polarization is obtained using a small magnetic loop because the magnetic loop is equivalent to an electric dipole.

A low-profile antenna that has better performance than the above-mentioned conventional antennas and can receive vertical polarized signals without affecting the appearance of a vehicle needs to be developed.

SUMMARY OF THE INVENTION

The present invention is directed to a low-profile antenna that can effectively receive vertical polarized signals particularly in a wireless broadband Internet (WiBro) band by generating a vertically polarized electric field despite having a small height to be horizontally mounted on the roof of a vehicle.

According to an aspect of the present invention, there is provided a low-profile antenna receiving vertical polarized signals, including: a laminated substrate formed into a structure in which a plurality of substrates having different permittivities are stacked; a radiator including a plurality of unit patches disposed on an upper surface of the laminated substrate, and configured to generate an electric field perpendicular to the upper surface of the laminated substrate; and ground vias formed from the respective unit patches to a ground plane disposed on a lower surface of the laminated substrate through the substrates constituting the laminated substrate.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Exemplary embodiments of the present invention will be described in detail below with reference to the accompanying drawings. While the present invention is shown and described in connection with exemplary embodiments thereof, it will be apparent to those skilled in the art that various modifications can be made without departing from the spirit and scope of the invention.

Figure 1:
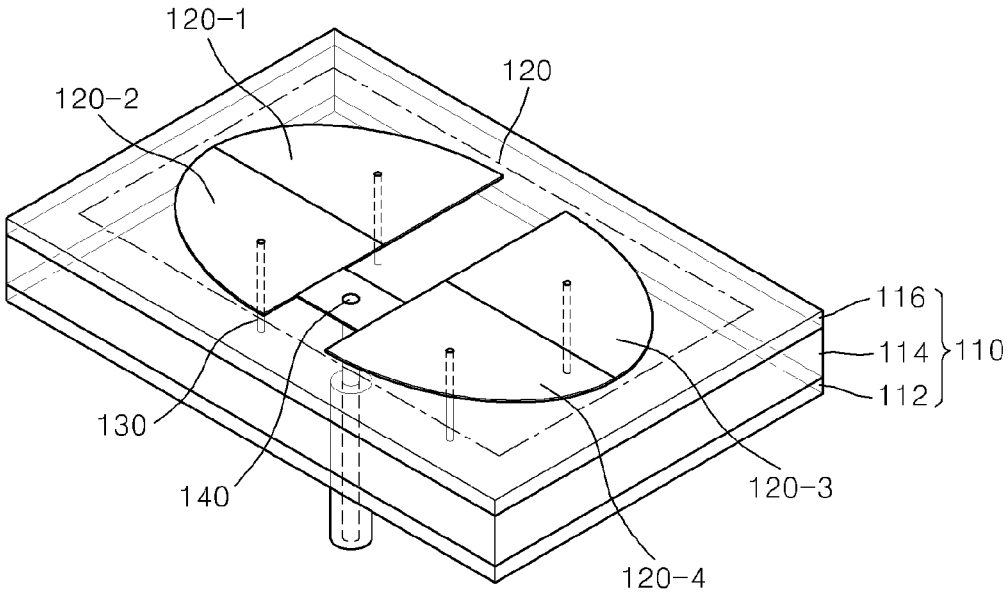
FIG. 1 is a perspective view showing a constitution of a low-profile antenna receiving vertical polarized signals according to an exemplary embodiment of the present invention.

FIG. 1 is a perspective view showing a constitution of a low-profile antenna receiving vertical polarized signals according to an exemplary embodiment of the present invention.

Referring to FIG. 1, a low-profile antenna according to an exemplary embodiment of the present invention is designed to include a plurality of unit patches 120-1, 120-2, 120-3, and 120-4 (referred to as "**120-*n*" below) disposed on an upper surface of a laminated substrate 110 having a multi-layer structure. In the low-profile antenna, ground vias 130 are formed from the respective unit patches 120-*n* to a ground plane on a lower surface of the laminated substrate 110 through substrates 112, 114, and 116 constituting the laminated substrate 110**.

As mentioned above, the low-profile antenna according to an exemplary embodiment of the present invention is designed to have a structure capable of receiving vertical polarized signals. A duality theorem stating that vertical distribution of current is equivalent to horizontal distribution of magnetic flux, and vice versa, is well known. The low-profile antenna according to an exemplary embodiment of the present invention is designed to have a horizontal magnetic antenna structure, rather than a vertical electric antenna structure, which can be achieved by a zero-phase constant. When an artificial shunt inductance such as a via is inserted in a microstrip patch antenna, the zero-phase constant is obtained at a specific frequency determined by parallel resonance between the shunt inductance and a parallel capacitance. Due to the zero-phase constant, an infinite wavelength is obtained from Equation 1 below.

$$\beta=2\pi/\lambda \qquad \text{[Equation 1]}$$

Here, $\beta$ is a phase constant, and $\lambda$ is a wavelength.

The specific frequency at which the zero-phase constant is obtained is defined as a zeroth-order resonant frequency. At the frequency, a uniform magnetic flux flows around the patches of the antenna. As a result, a low-profile horizontal magnetic antenna is implemented.

Figure 2:
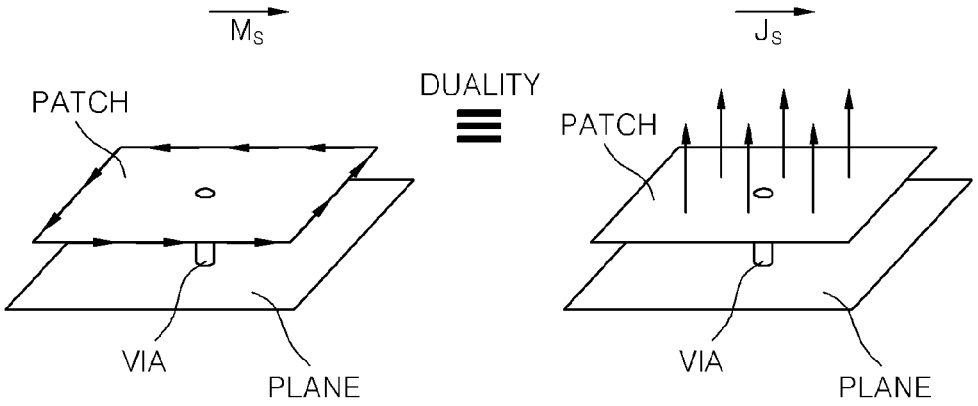
FIG. 2 illustrates duality between horizontal distribution of magnetic flux and vertical distribution of current.

FIG. 2 illustrates duality between horizontal distribution of magnetic flux and vertical distribution of current. Referring to FIG. 2, a magnetic flux loop is uniformly generated around a patch, and is equivalent to the flow of current occurring perpendicular to the patch. The low-profile antenna according to an exemplary embodiment of the present invention has a structure in which a magnetic flux loop as shown in FIG. 2 is generated around the unit patches **120-*n* disposed on the upper surface of the laminated substrate 110** to result in vertical polarization waves.

Referring back to FIG. 1, the respective unit patches **120-*n* and the ground vias 130 connected to the unit patches 120-*n* may be expressed by a serial inductance $L_R$ and a serial capacitance $C_L$, and a parallel inductance $L_L$ and a parallel capacitance $C_R$. To be specific, the serial inductance $L_R$ is determined by a width of the unit patches 120-*n*, the serial capacitance $C_L$ is determined by a gap between the unit patches 120-*n*, the parallel inductance $L_L$ is determined by the ground vias 130, and the parallel capacitance $C_R$ is determined by a distance from the unit patches 120-*n* to the ground plane, that is, a height of the laminated substrate 110**.

The laminated substrate 110 has a structure for meeting a bandwidth required according to properties of a signal. In the structure according to a representative exemplary embodiment of the present invention, the first substrate 112, the second substrate 114, and the third substrate 116 are stacked in sequence on the ground plane. When the laminated substrate 110 is implemented to be actually applied to a Korean wireless broadband Internet (WiBro) service, a flame retardant type 4 (FR4) substrate having a permittivity $\in_r$ of 4.4 and a thickness of 1.6 mm may be used as the first substrate 112 and the third substrate 116, and a foam material having substantially the same permittivity ($\approx$1) as air and a thickness of 5 mm may be used as the second substrate 114. This structure is selected to widen a bandwidth.

The plurality of unit patches **120-*n* disposed on the upper surface of the laminated substrate 110, that is, an upper surface of the third substrate 116 corresponding to the uppermost layer of the laminated substrate 110, constitute a radiator 120 that generates an electric field perpendicular to the upper surface of the laminated substrate 110. The number of the unit patches 120-*n* constituting the radiator 120 may be four as shown in FIG. 1, and the respective unit patches 120-*n* may have a one-quarter oval shape of the same size. The four unit patches 120-*n* are disposed in an oval shape to constitute the radiator 120 as shown in FIG. 1, and the neighboring unit patches 120-*n* are disposed for the above-mentioned serial capacitance $C_L$ with a gap of a previously set length interposed between the neighboring unit patches 120-*n*. In this way, the low-profile antenna according to an exemplary embodiment of the present invention has the oval radiator 120 consisting of the four rounded unit patches 120-*n***, thereby having a wider bandwidth and higher gain than a conventional antenna in which a plurality of rectangular patches are disposed in one line to constitute a transmission line.

The above-mentioned shapes of the unit patches **120-*n* and the above-mentioned disposition of the unit patches 120-*n* for constituting the radiator 120 correspond to a representative exemplary embodiment of the present invention for maximizing a bandwidth of a low-profile antenna, and shapes of the unit patches 120-*n* and a disposition of the unit patches 120-*n* for constituting the radiator 120 are not limited to those mentioned above. In other words, the unit patches 120-*n* may have general rectangular shapes, and the plurality of unit patches 120-*n* may be disposed in one line to constitute the radiator 120**.

Referring to FIG. 1, a gap formed between the unit patches **120-*n* corresponding to one axis of the oval is larger than a gap formed between the unit patches 120-*n* corresponding to the other axis of the oval, and feeding is performed through one point in the large gap. In other words, a feeding patch 140 for power feeding is disposed in an area between the unit patches 120-*n* corresponding to the one axis of the oval. The power feeding of the low-profile antenna according to an exemplary embodiment of the present invention through the feeding patch 140 is in accordance with a coaxial feeding method. Such a position of the feeding patch 140** has been determined in consideration of impedance matching.

Figure 3:
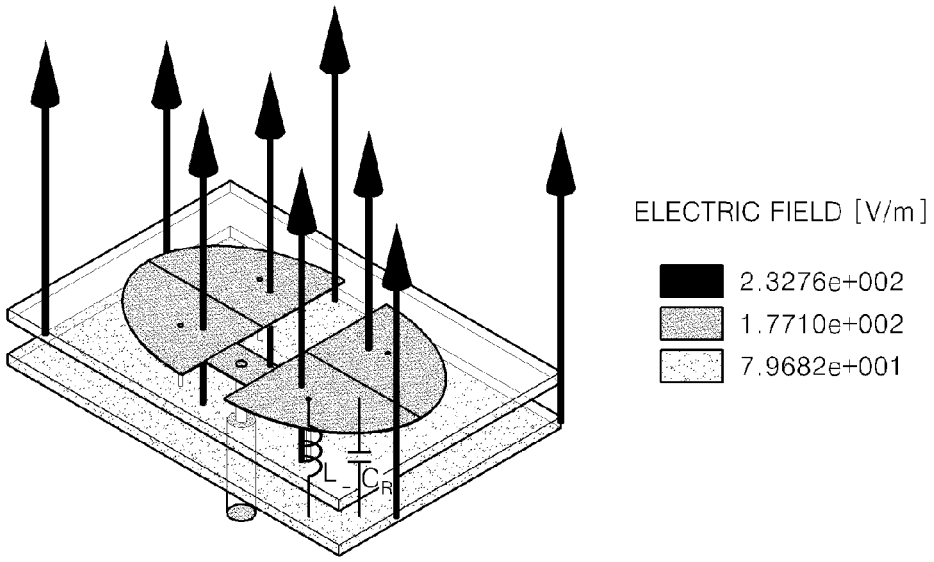
FIG. 3 illustrates distribution of an electric field generated from a low-profile antenna according to an exemplary embodiment of the present invention.

FIG. 3 illustrates distribution of an electric field generated from the low-profile antenna according to an exemplary embodiment of the present invention. Referring to FIG. 3, an electric field is formed to be perpendicularly polarized with respect to the upper surface of the laminated substrate 110. Due to the distribution of an electric field, the low-profile antenna according to an exemplary embodiment of the present invention generates the zero-phase constant and has an appropriate structure for receiving vertically-polarized signals.

As described above, the low-profile antenna according to an exemplary embodiment of the present invention has a structure capable of receiving vertically-polarized signals even when horizontally disposed, and thus can be horizontally mounted on a vehicle roof when the low-profile antenna is implemented as a vehicle antenna. To implement the low-profile antenna according to an exemplary embodiment of the present invention as a vehicle antenna, mounting conditions of a vehicle need to be taken into consideration.

Figure 4:
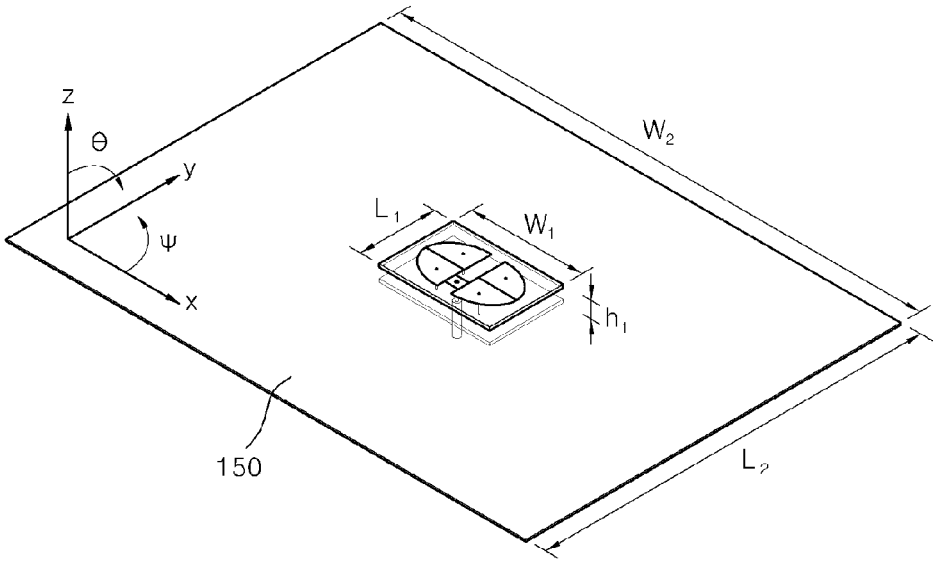
FIG. 4 illustrates an example in which a low-profile antenna according to an exemplary embodiment of the present invention is disposed on a large aluminum ground plane.

In a simulation environment for evaluating performance when the low-profile antenna according to an exemplary embodiment of the present invention is mounted on a vehicle roof, the vehicle roof may replace a large ground plane. In this way, simulation time can be reduced. FIG. 4 illustrates an example in which the low-profile antenna according to an exemplary embodiment of the present invention is disposed on a large aluminum ground plane. For a simulation, an aluminum ground plane 150 may be used instead of a vehicle roof as shown in FIG. 4.

When the antenna as shown in FIG. 4 is actually manufactured, the first substrate 112 and the third substrate 116 constituting the laminated substrate 110 may be FR4 substrates having a thickness of 1.6 mm and a permittivity of 4.4, and the second substrate 114 may be a foam substrate having a thickness of 5 mm and a permittivity of 1.

Lengths of respective sides of the antenna shown in FIG. 4 are 40 mm ($L_1$)×50 mm ($W_1$)×8.2 mm ($h_1$), and an electric magnitude of the antenna is $0.306\lambda_0 \times 0.383\lambda_0 \times 0.062\lambda_0$ at a frequency of 2.3 GHz. The narrow gap between the unit patches 120-*n* constituting the radiator 120 is 0.2 mm. The aluminum ground plane 150 of FIG. 4 may have a size of 300 mm ($L_2$)×300 mm ($W_2$) and a thickness of 1 mm, which is expressed as an electric magnitude of $2.3\lambda_0 \times 2.3\lambda_0 \times 0.007\lambda_0$.

Meanwhile, the low-profile antenna according to an exemplary embodiment of the present invention may be contained in a package and protected from an external environment. In this case, an external size of the package of the antenna is 50 mm ($L_3$)×60 mm ($W_3$)×14.5 mm ($h_3$), and an electric magnitude is $0.383\lambda_0 \times 0.460\lambda_0 \times 0.111\lambda_0$. Also, an internal size of the package of the antenna is 45 mm×55 mm×12.5 mm. The package may be made from acrylonitrile butadiene styrene (ABS), which is currently widely used for commercial vehicle antennas such as a shark fin antenna. When the antenna contained in the package is manufactured and a simulation of the antenna is performed, the package has a permittivity of 2.32 and a tangential loss of 0.0002.

Through experimental results, it will be described below that a simplified simulation model in which the aluminum ground plane 150 is used is appropriate for evaluating the performance of an exemplary embodiment of the present invention. The performance of the low-profile antenna according to an exemplary embodiment of the present invention may be first confirmed through an examination in an anechoic chamber, and then an outdoor experiment is carried out with the low-profile antenna mounted on a roof of a midsize vehicle. Further, results of observing variation in impedance and a radiation pattern before and after the low-profile antenna is contained in the package are disclosed to describe the influence that the package has on the performance of the low-profile antenna according to an exemplary embodiment of the present invention.

Figure 5:
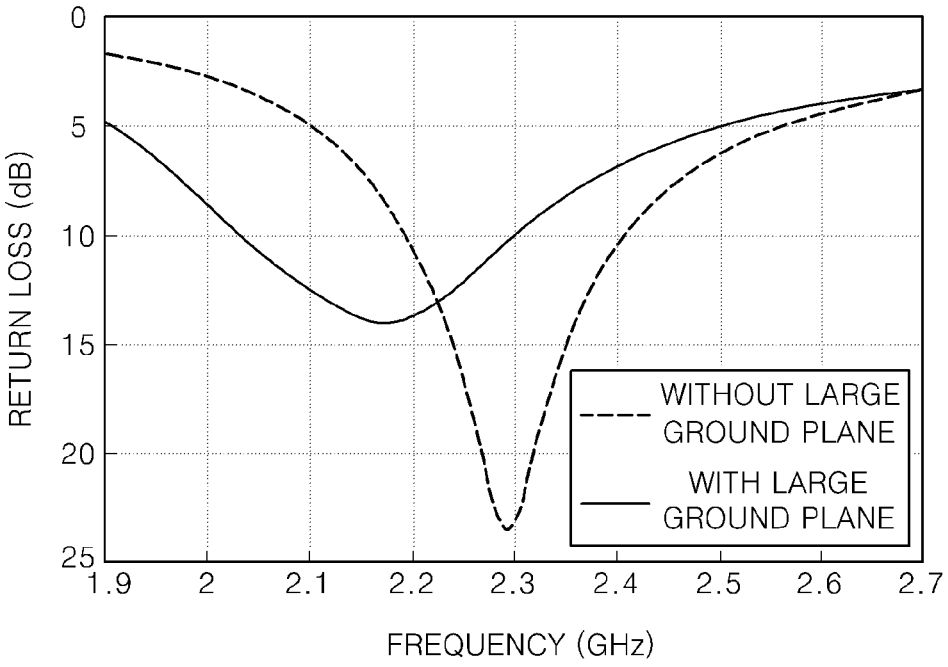
FIG. 5 is a graph showing return loss obtained as simulation results of a case where a large ground plane is included and a case where a large ground plane is not included.

The low-profile antenna according to an exemplary embodiment of the present invention was manufactured for vehicles as mentioned above, and a simulation was performed using a high-frequency structural simulator (HFSS) of Ansoft Corp. The antenna was designed to have a bandwidth of 10 dB in a WiBro band of 2.3 to 2.4 GHz. FIG. 5 is a graph showing return loss obtained as simulation results of a case where a large ground plane is included and a case where a large ground plane is not included. Referring to FIG. 5, when a large ground plane was used, a resonant frequency was reduced from 2.3 GHz, which was obtained when a large ground plane as shown in FIG. 4 was not used, to 2.16 GHz, and minute impedance mismatch occurred. Thus, the antenna was slightly modified to estimate the optimum performance of a case where the antenna was actually mounted on a vehicle roof.

Figure 6:
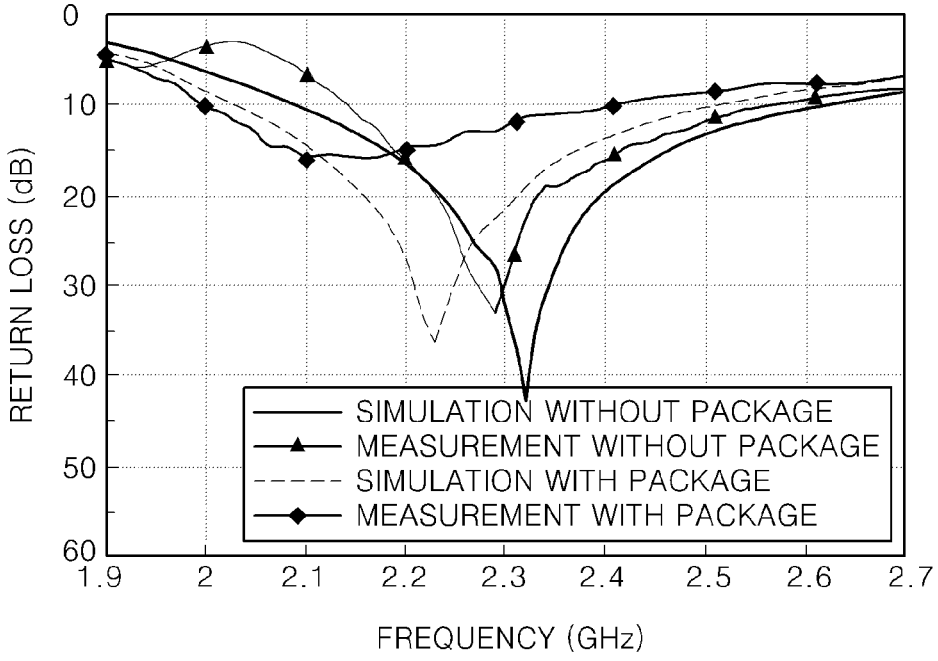
FIG. 6 is a graph showing return loss of an antenna that includes a large ground plane and has a modified structure.

FIG. 6 is a graph showing return loss of an antenna that includes a large ground plane and has a modified structure. In the graph of FIG. 6, return loss in accordance with whether or not a package was used is shown as well. Comparing resonant frequencies in accordance with whether or not a package was used with each other, a resonant frequency was reduced by about 200 MHz after the antenna was contained in a package but still satisfied a frequency condition required for the WiBro band. As actual measurement results, a return loss of 33 dB was obtained at 2.3 GHz before the antenna was contained in a package, and a return loss of 16 dB was obtained at 2.1 GHz after the antenna was contained in a package. A 10-dB bandwidth of the low-profile antenna according to an exemplary embodiment of the present invention contained in a package was 2 to 2.4 GHz, which was calculated to be 18.2%. This measurement result slightly differs from a simulation result due to the difference in experimental environments.

Figure 7A:
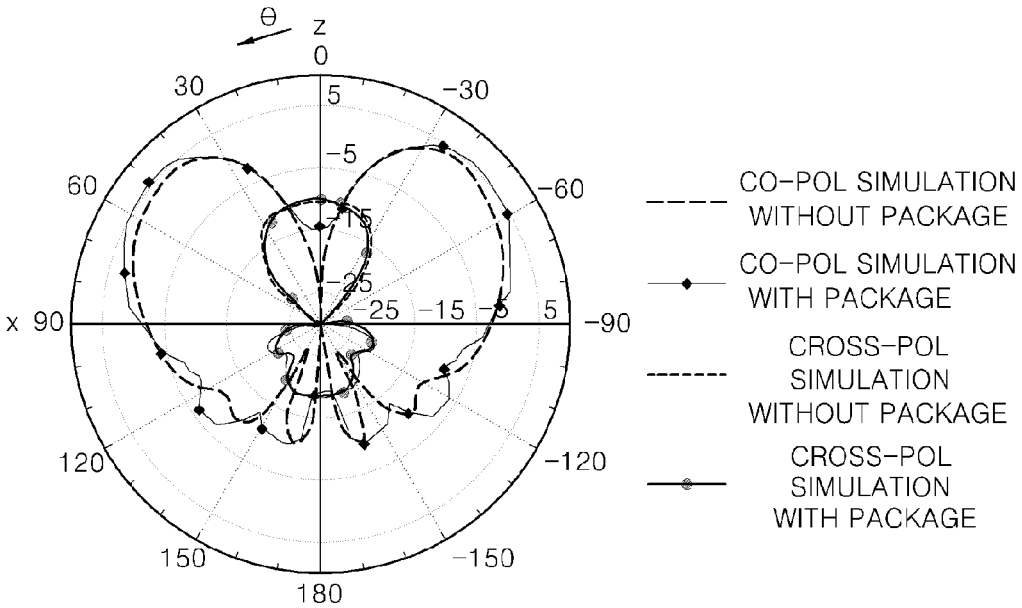
FIGS. 7A and 7B show simulated radiation patterns in an X-Z plane (E plane) and an X-Y plane (H plane), respectively.
Figure 7B:
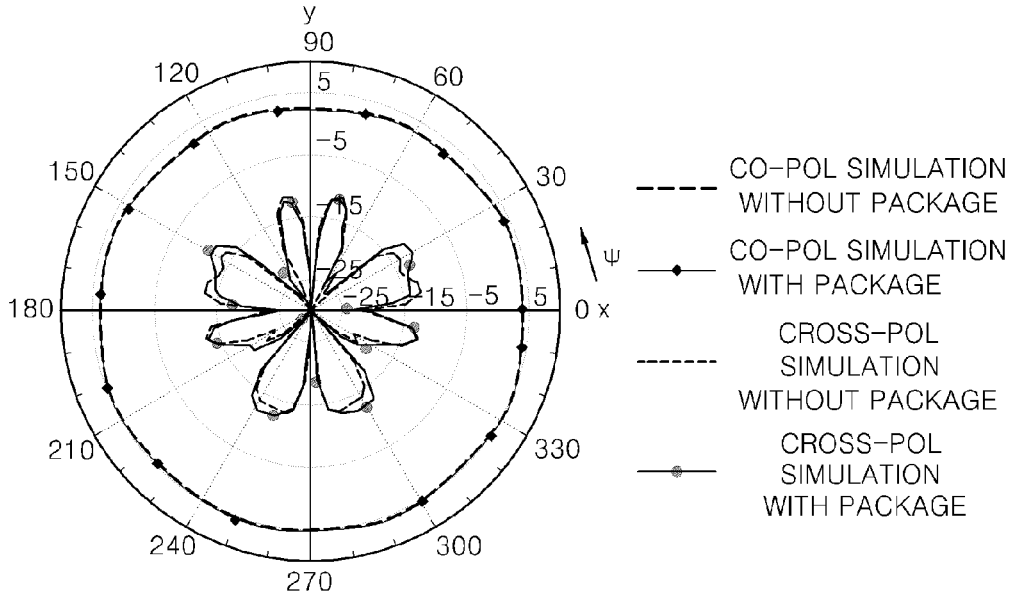

Next, a radiation characteristic of the low-profile antenna according to an exemplary embodiment of the present invention was measured in an anechoic chamber. FIGS. 7A and 7B show simulated radiation patterns in an X-Z plane (E plane) and an X-Y plane (H plane) respectively, and FIGS. 8A and 8B show measured radiation patterns in an X-Z plane (E plane) and an X-Y plane (H plane) respectively.

Figure 8A:
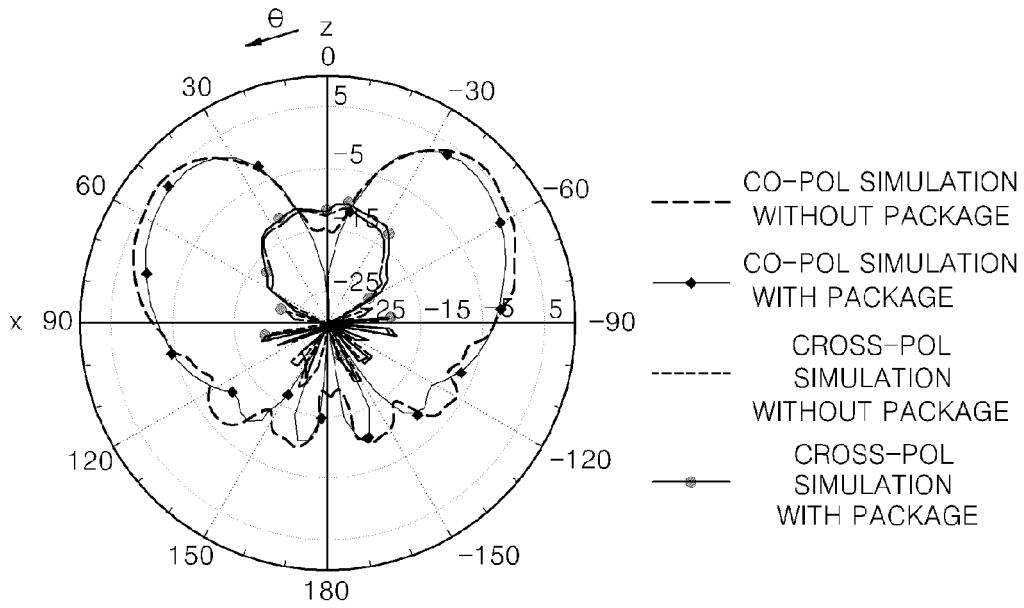
FIGS. 8A and 8B show measured radiation patterns in an X-Z plane (E plane) and an X-Y plane (H plane), respectively.
Figure 8B:
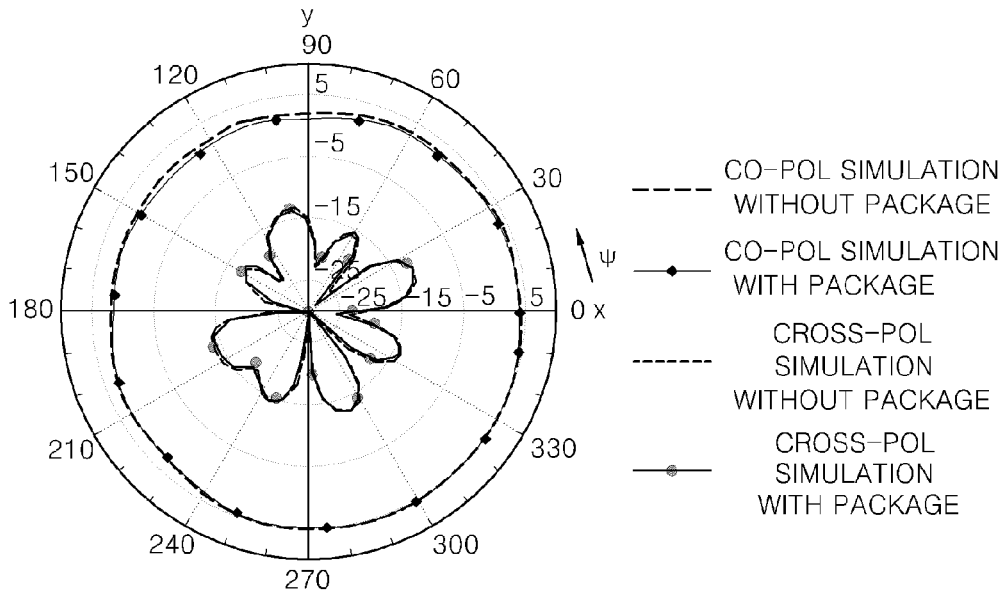

Referring to measured results shown in FIG. 8A, even when the low-profile antenna according to an exemplary embodiment of the present invention was contained in a package, the peak gain of 4.5 dBi was measured at 50°, and a radiation pattern did not vary in comparison with a case where no package was used. Also, a measured cross-polarization level was 17 dBi at 50°. Referring to a gain pattern shown in FIG. 8B, a gain of 3.5 dBi and a cross-polarization level of 18 dBi were obtained in an azimuth direction after the antenna was contained in a package. Comparing the actual measurement results with the simulation results shown in FIGS. 7A and 7B, the simulation results are almost the same as the measurement results. The simulation results confirm that vertically-polarized signals are received at an elevation angle of ±50°. Thus, when the low-profile antenna according to an exemplary embodiment of the present invention is applied to a vehicle, vertically-polarized signals in the WiBro band can be effectively received. Further, the low-profile antenna according to an exemplary embodiment of the present invention shows an omnidirectional radiation pattern in an azimuth plane.

Figure 9:
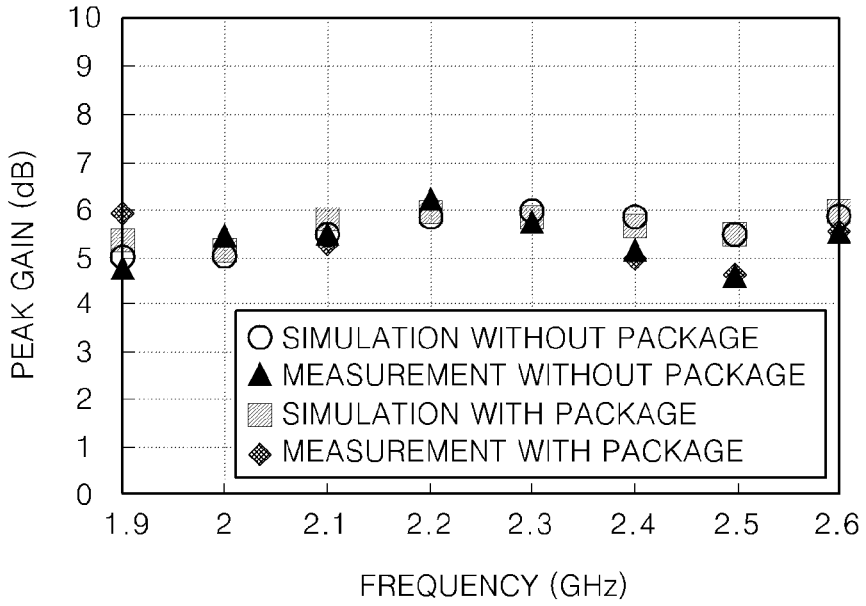
FIG. 9 shows the peak gains of simulated and measured radiation patterns obtained in a band of 1.9 GHz to 2.6 GHz.
Figure 10:
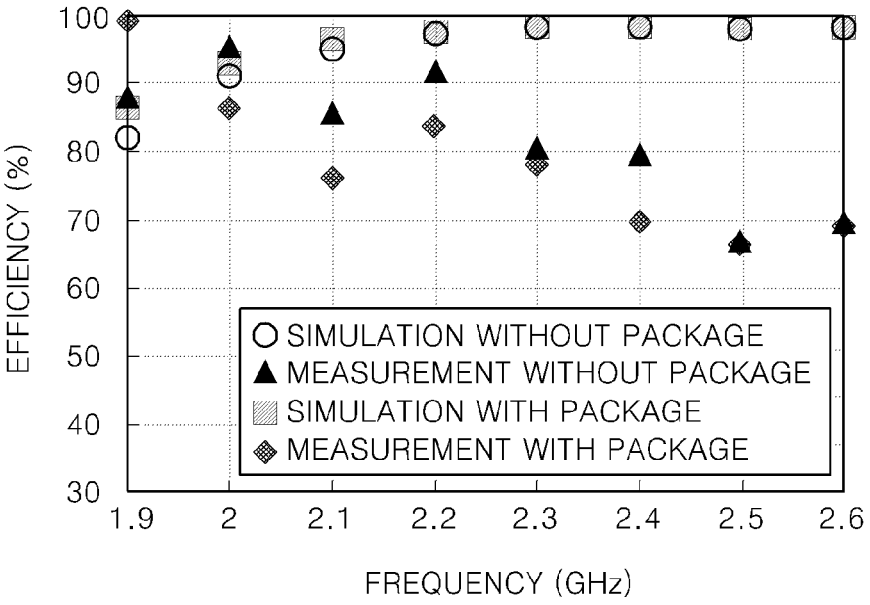
FIG. 10 shows antenna efficiencies of simulated and measured radiation patterns obtained in a band of 1.9 GHz to 2.6 GHz.

Simulation and actual measurement results of the peak gain and efficiency obtained in a band of 1.9 to 2.6 GHz are shown in FIGS. 9 and 10. In the graphs of FIGS. 9 and 10, results obtained according to whether or not a package is included are shown as well. It can be seen from FIG. 9 that the peak gain is higher than 4.5 dBi in the band of 1.9 to 2.6 GHz, and from FIG. 10 that radiation efficiency is 67% or more.

Here, the radiation efficiency is calculated by measuring the total radiated power in a three-dimensional (3D) radiation pattern.

The above-described simulation and measurement results are results of evaluating the performance of the low-profile antenna according to an exemplary embodiment of the present invention when the large ground plane 150 shown in FIG. 4 is used. The performance of the low-profile antenna according to an exemplary embodiment of the present invention will be described below on the basis of the results of an experiment carried out with the antenna actually mounted on a vehicle roof.

Figure 11:
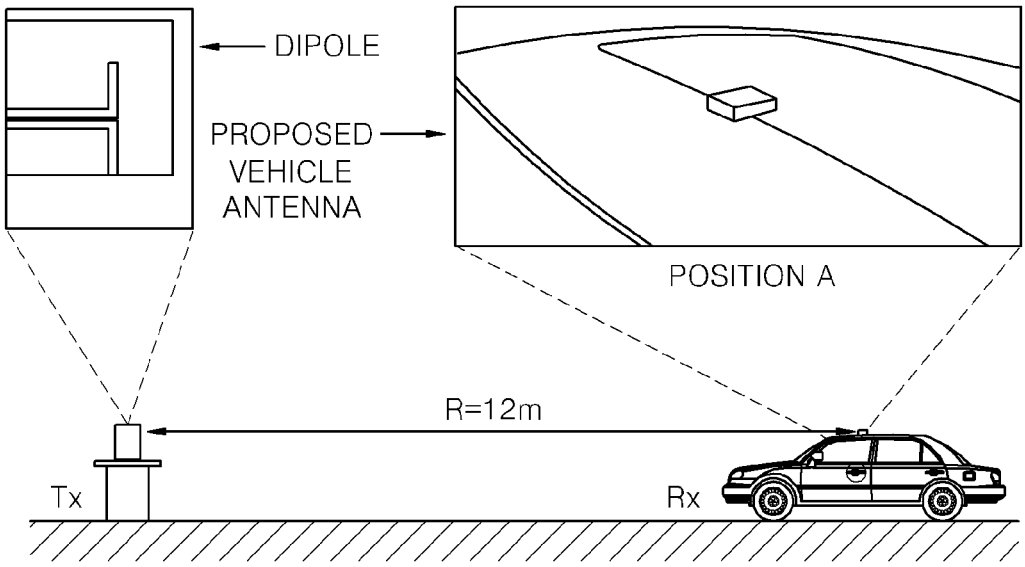
FIG. 11 illustrates an experiment carried out for performance evaluation when a low-profile antenna according to an exemplary embodiment of the present invention was actually applied to a vehicle.
Figure 11:
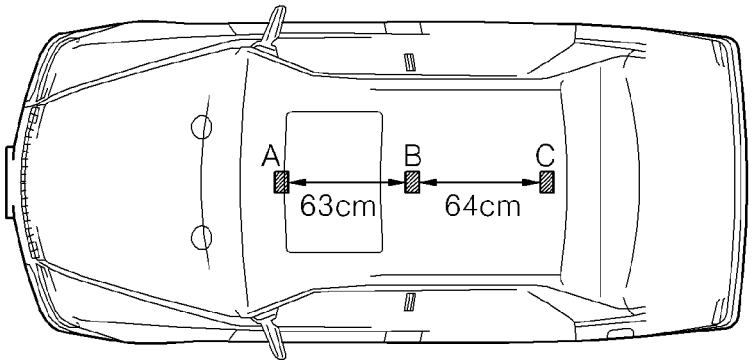

FIG. 11 illustrates an experiment carried out for performance evaluation when the low-profile antenna according to an exemplary embodiment of the present invention was actually applied to a vehicle. In the experiment, a midsized vehicle was used, and a 2.3-GHz vertical polarization signal was transmitted from a printed dipole antenna installed to check signal receiving performance. As shown in FIG. 11(A), a transmitter Tx that transmits a vertical polarization signal was disposed at a position spaced apart from a vehicle by a predetermined distance. After the low-profile antennas according to an exemplary embodiment of the present invention were mounted at three different positions A, B, and C on the roof of the vehicle as shown in FIG. 11(B), the experiment was performed. Also, a spectrum analyzer was installed in the vehicle to measure a level of a received signal. The spectrum analyzer in the vehicle and the antenna mounted on the outer surface of the vehicle roof were connected through a radio frequency (RF) cable, which was installed to pass through a sun-roof of the vehicle.

Figure 12:
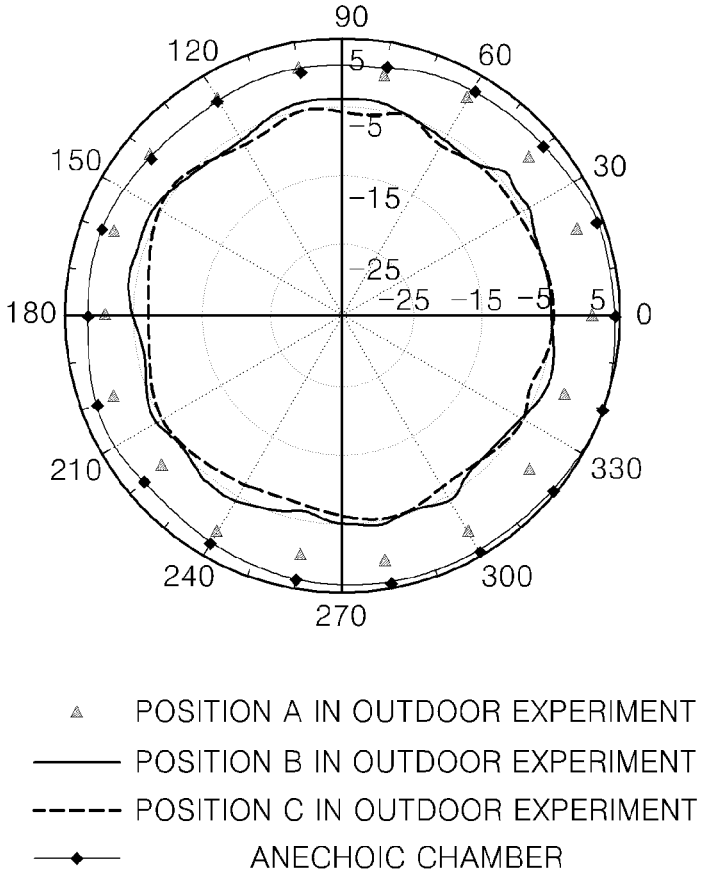
FIG. 12 shows azimuth radiation patterns according to positions on a vehicle roof where an antenna was mounted, and an azimuth radiation pattern according to results of an experiment carried out in an anechoic chamber.

Distances from the three positions A to C shown in FIG. 11(B) to the transmitter Tx were 12 m, 12.63 m, and 13.27 m respectively, and the low-profile antennas according to an exemplary embodiment of the present invention were mounted at the respective positions A, B, and C as shown in FIG. 11(A). FIG. 12 shows azimuth radiation patterns according to positions on a vehicle roof where an antenna was mounted, and an azimuth radiation pattern according to results of an experiment carried out in an anechoic chamber. Referring to FIG. 12, the low-profile antenna according to an exemplary embodiment of the present invention showed the highest gain when mounted at the position A on the vehicle roof. However, an antenna mounting position at which the highest gain is obtained may vary according to vehicle types and transmitter positions. Further, the low-profile antenna according to an exemplary embodiment of the present invention showed similar results when actually mounted on the vehicle roof and when an experiment was performed in the chamber. Thus, even when the low-profile antenna according to an exemplary embodiment of the present invention is actually applied to a vehicle, it is possible to estimate that the antenna will show an excellent bandwidth and excellent efficiency on the basis of the experimental results of the above-described case where a large ground plane is used.

As described above, in a low-profile antenna receiving vertical polarized signals according to an exemplary embodiment of the present invention, a radiator consisting of a plurality of patches is disposed on an upper surface of a laminated substrate having a structure in which a plurality of substrates are stacked. Thus, a horizontal magnetic loop is generated around the patches, and vertical polarization signals can be received due to an electric field perpendicular to the upper surface of the substrate. Also, the unit patches having a one-quarter oval shape are disposed to constitute an oval radiator with a gap interposed between them, so that a bandwidth can be widened.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A low-profile antenna, comprising:

a laminated substrate formed into a structure in which a plurality of substrates having different permittivity are stacked;

a radiator consisting of a plurality of unit patches disposed on an upper surface of the laminated substrate, and configured to generate an electric field perpendicular to the upper surface of the laminated substrate; and ground vias formed from the respective unit patches to a ground plane disposed on a lower surface of the laminated substrate through the substrates constituting the laminated substrate.

2. The low-profile antenna of claim 1, wherein the laminated substrate is formed into the structure in which a first substrate, a second substrate, and a third substrate are stacked in sequence on the ground plane, wherein the first substrate and the third substrate have the same permittivity, and the second substrate is foam.

3. The low-profile antenna of claim 1, wherein a thickness of the laminated substrate and a distance between the unit patches are set to values for obtaining a previously set resonant frequency.

4. The low-profile antenna of claim 2, wherein a thickness of the laminated substrate and a distance between the unit patches are set to values for obtaining a previously set resonant frequency.

5. The low-profile antenna of claim 1, wherein the unit patches have a one-quarter oval shape, and four of the unit patches having the same size are disposed in an oval shape to constitute the radiator.

6. The low-profile antenna of claim 2, wherein the unit patches have a one-quarter oval shape, and four of the unit patches having the same size are disposed in an oval shape to constitute the radiator.

7. The low-profile antenna of claim 5, wherein a feed point for power feeding in accordance with a coaxial feeding method is set in a gap between the unit patches corresponding to one axis of the oval shape.

8. The low-profile antenna of claim 6, wherein a feed point for power feeding in accordance with a coaxial feeding method is set in a gap between the unit patches corresponding to one axis of the oval shape.

9. The low-profile antenna of claim 7, wherein a width of the one axis of the oval shape in which the feed point is set is greater than a width of the other axis of the oval shape, and a feeding patch of a previously set size is disposed at a position where the feed point is set.

10. The low-profile antenna of claim 8, wherein a width of the one axis of the oval shape in which the feed point is set is greater than a width of the other axis of the oval shape, and a feeding patch of a previously set size is disposed at a position where the feed point is set.

11. The low-profile antenna of claim 1, wherein the low-profile antenna is contained in a package disposed on the ground plane to cover the laminated substrate.

12. The low-profile antenna of claim 1, wherein the ground plane is an upper surface of a vehicle roof.

* * * * *